US006120265A

United States Patent [19]

Wu

[11] Patent Number: 6,120,265

[45] Date of Patent: Sep. 19, 2000

[54] TWO-STROKE OPERABLE PUMP

[76] Inventor: Scott Wu, P.O. Box 63-247, Taichung, Taiwan

[21] Appl. No.: 09/268,065

[22] Filed: Mar. 15, 1999

[51] Int. Cl.[7] ..... F04B 1/00

[52] U.S. Cl. ..... 417/526; 417/531; 417/534

[58] Field of Search ..... 417/234, 526, 417/531, 63, 467, 440, 534; 92/256

[56] References Cited

U.S. PATENT DOCUMENTS

| | | | |
|---|---|---|---|
| 5,180,283 | 1/1993 | Vickery, III | 417/234 |
| 5,531,575 | 7/1996 | Lin | 417/526 |
| 5,626,072 | 5/1997 | Mirand et al. | 92/256 |
| 5,683,234 | 11/1997 | Chuang et al. | 417/531 |
| 5,713,723 | 2/1998 | Hathaway | 417/63 |
| 5,779,457 | 7/1998 | Chuang et al. | 417/467 |
| 5,902,097 | 5/1999 | Wu | 417/440 |
| 6,017,196 | 1/2000 | Wu | 417/234 |
| 6,027,319 | 2/2000 | Winefordner et al. | 417/440 |

*Primary Examiner*—Teresa Walberg
*Assistant Examiner*—Leonid Fastovsky
*Attorney, Agent, or Firm*—Alan Kamrath; Oppenheimer Wolff & Donnelly LLP

[57] ABSTRACT

A pump includes a main body, an inner tube mounted in the main body, and a hollow piston slidably mounted in the main body and partially receiving the inner tube. A piston is mounted in the main body and slidable along the inner tube. Two O-rings are mounted in two annular grooves in an outer periphery of the piston. A plug is secured to a lower end of the inner tube and includes two O-rings in two annular groove in an outer periphery thereof. A handle is attached to the piston rod for manual operation. The annular grooves of the piston and the plug include notches arranged in a manner to allow air to be outputted during each stroke of the piston rod.

2 Claims, 13 Drawing Sheets

TWO-STROKE OPERABLE PUMP

BACKGROUND OF THE INVENTION

1. Field of the Invention

The present invention relates to a two-stroke operable hand air pump that may pump air during every stroke of the piston.

2. Description of the Related Art

A conventional air pump may output air in an output stroke only such that the user is exhausted very soon. A two-stroke operable pump has been proposed to output air during every stroke of the piston. Two sealing rings each having an annularly extending conic lip are respectively mounted in two annular grooves of the piston such that the conic lips face each other. The lips are in sealing contact with an inner periphery of a cylinder. In addition, each lip is deformable toward the piston rod to allow passage of air, thereby allowing output of air during each stroke of the piston. It is, however, found that, air tends to leak in the lip portion, as the lip that is compressed by high pressure air is hollow. Applicant's U.S. patent application Ser. No. 09/211,120 discloses improved two-stroke operable pumps that successfully solve this problem. The present invention provides different designs in this regard.

SUMMARY OF THE INVENTION

It is a primary object of the present invention to provide an improved two-stroke operable pump for outputting air during each stroke of the piston.

In accordance with one aspect of the invention, a pump comprises:

a main body defining a chamber therein and including a first end and a second end, a head mounted to the first end of the main body and including a main passage that is adapted to be communicated with a valve, the head further including a first passage, an inner tube securely mounted in the main body and having an interior communicated with the main passage of the head, the inner tube including a first end secured in the first end of the main body and a second end, a hollow piston slidably received in the main body, the hollow piston separating the chamber of the main body into a first chamber adjacent to the head and a second chamber distal to the head, the first chamber being communicated with atmosphere via the first passage of the head, the hollow piston further including a first annular groove defined in an outer periphery thereof and adjacent to the first end of the main body, the hollow piston head further including a second annular groove defined in the outer periphery and adjacent to the second end of the main body, the first annular groove including a first notch extended along a longitudinal direction of the hollow piston, the second annular groove including a second notch extended along the longitudinal direction of the hollow piston, a first O-ring being mounted in the first annular groove and slidable along the longitudinal direction of the hollow piston, a second O-ring being mounted in the second annular groove and slidable along the longitudinal direction of the hollow piston, the hollow piston including an inner periphery, the inner periphery including a reduced first section in sliding and sealing contact with an outer periphery of the inner tube, the inner periphery further including a second section having an inner diameter greater than that of the reduced first section, the hollow piston further including a first transverse hole defined therein to communicate an interior of the second section with a first space between the first O-ring, the second O-ring, and an inner periphery of the main body, a first valve means mounted in first end of the main body such that air is only flowable from atmosphere to the first chamber of the main body via the first passage, a hollow piston rod having a first end attached to the piston and a second end extended outside the main body, the hollow piston rod including a compartment therein for partially receiving the inner tube, a plug mounted in the piston rod and secured to the second end of the inner tube, the plug separating the compartment in the piston rod into a third chamber that is adjacent to the piston and a fourth chamber that is distal to the piston, the second end of the piston rod including a second passage that communicates with the fourth chamber with atmosphere, the plug including a third annular groove defined in an outer periphery thereof and adjacent to the piston and a fourth annular groove defined in the outer periphery thereof and distal to the piston, the third annular groove including a third notch extended along a longitudinal direction of the inner tube and distal to the piston, the fourth annular groove including a fourth notch extended along a longitudinal direction of the inner tube and adjacent to the inner tube, a third O-ring being mounted in the third annular groove and slidable along the longitudinal direction of the inner tube, a fourth O-ring being mounted in the fourth annular groove and slidable along the longitudinal direction of the inner tube, the plug further including a second transverse hole extended between the third annular groove and the fourth annular groove along a radial direction to communicate an interior of the inner tube with a second space between the third annular groove, the fourth annular groove, and an inner periphery of the piston rod, an end cap mounted to seal the second end of the main body and including a third passage that communicates the second chamber of the main body with atmosphere, a second valve means mounted in second end of the piston rod such that air is only flowable from atmosphere to the fourth chamber of the piston rod via the second passage of the piston rod, a third valve means mounted in second end of the main body such that air is only flowable from atmosphere to the second chamber of the main body via the third passage of the end cap, a handle attached to the second end of the piston rod for operation, wherein when during an outward stroke of the piston in which the handle moves away from the main body, the second O-ring is moved to abut an end edge of the second notch to allow communication between the first space and the second chamber while the first O-ring prevents communication between the first chamber and the first space, the third O-ring is, moved to abut an end edge of the third notch to allow communication between the third chamber and the second space while the fourth O-ring prevents communication between the fourth chamber and the second space, such that air in the second chamber is outputted to the main passage via the first space, the first transverse hole, the third chamber, the second space, the second transverse hole, and the inner tube, while ambient air enters the first chamber via the first passage of the head and enters the fourth chamber via the second passage in the second end of the piston rod, and wherein when during an inward stroke of the piston in which the handle moves toward the main body, the first O-ring is moved to abut an end edge of the first notch to allow communication between the first space and the first chamber while the second O-ring prevents communication between the second chamber and the first space, the fourth O-ring is moved to abut an end edge of the fourth notch to allow communication between the second space and the fourth chamber while the third O-ring prevents communication between the third chamber and the second space, such that air in the fourth chamber is outputted to the main passage via the second space, the second transverse hole, and the inner tube, while air in the first chamber enters the third chamber via the first space and the first transverse hole.

In accordance with another aspect of the invention, a pump comprises:

a main body defining a chamber therein and including a first end and a second end, a head mounted to the first end of the main body and including a main passage that is adapted to be communicated with a valve, an inner tube securely mounted in the main body and having an interior communicated with the main passage of the head, the inner tube including a first end secured in the first end of the main body and a second end, a hollow piston slidably received in the main body, the hollow piston separating the: chamber of the main body into a first chamber adjacent to the head and a second chamber distal to the head, the hollow piston further including a first annular groove defined in an outer periphery thereof, the hollow piston further including a second annular groove defined in an outer periphery thereof, the first annular groove including a first notch in an upper edge thereof and extended along a longitudinal direction of the hollow piston, the second annular groove including a second notch in a lower edge thereof and extended along the longitudinal direction of the hollow piston, a first O-ring being mounted in the first annular groove and slidable along the longitudinal direction of the hollow piston, a second O-ring being mounted in the second annular groove and slidable along the longitudinal direction of the hollow piston, a hollow piston rod having a first end attached to the piston and a second end extended outside the main body, the hollow piston rod including a compartment therein for partially receiving the inner tube, a plug mounted in the piston rod and secured to the second end of the inner tube, the plug separating the compartment in the piston rod into a third chamber that is adjacent to the piston and a fourth chamber that is distal to the piston, the second end of the piston rod including a first passage that communicates with the fourth chamber with atmosphere, the plug including a third annular groove defined in an outer periphery thereof and adjacent to the piston and a fourth annular groove defined in the outer periphery thereof and distal to the piston, the third annular groove including a third notch extended along a longitudinal direction of the inner tube and distal to the piston, the fourth annular groove including a fourth notch extended along a longitudinal direction of the inner tube and adjacent to the inner tube, a third O-ring being mounted in the third annular groove and slidable along the longitudinal direction of the inner tube, a fourth O-ring being mounted in the fourth annular groove and slidable along the longitudinal direction of the inner tube, the plug further includes a second transverse hole extended between the third annular groove and the fourth annular groove along a radial direction to communicate an interior of the inner tube with a space between the third annular groove, the fourth annular groove, and an inner periphery of the piston rod, an end cap mounted to seal the second end of the main body and including a second passage that communicates the second chamber of the main body with atmosphere, a first valve means mounted to in second end of the piston rod such that air is only flowable from atmosphere to the fourth chamber of the piston rod via the first passage of the piston rod, a second valve means mounted to in second end of the main body such that air is only flowable from atmosphere to the second chamber of the main body via the second passage of the end cap, a handle attached to the second end of the piston rod for operation, wherein when during an outward stroke of the piston in which the handle moves away from the main body, the first O-ring is moved to abut an end edge of the first notch to allow communication between the first chamber and the second chamber while the second O-ring prevents communication between the first chamber and the third chamber, the third O-ring is moved to abut an end edge of the third notch to allow communication between the third chamber and the space while the fourth O-ring prevents communication between the fourth chamber and the space, such that air in the third chamber is outputted to the main passage via the space, the transverse hole, and the inner tube, while ambient air enters the third chamber via the second end of the piston rod, and ambient air enters the first chamber via the second chamber and the first notch, wherein when during an inward stroke of the piston in which the handle moves toward the main body, the second O-ring is moved to abut an end edge of the second notch to allow communication between the first chamber and the third chamber while the first O-ring prevents communication between the second chamber and the first chamber, the fourth O-ring is moved to abut an end edge of the fourth notch to allow communication between the space and the fourth chamber while the third O-ring prevents communication between the third chamber and the space, such that air in the fourth chamber is outputted to the main passage via the space, the transverse hole, and the inner tube, while air in the first chamber enters the third chamber via the second notch and ambient air enters the second chamber via the first passage.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
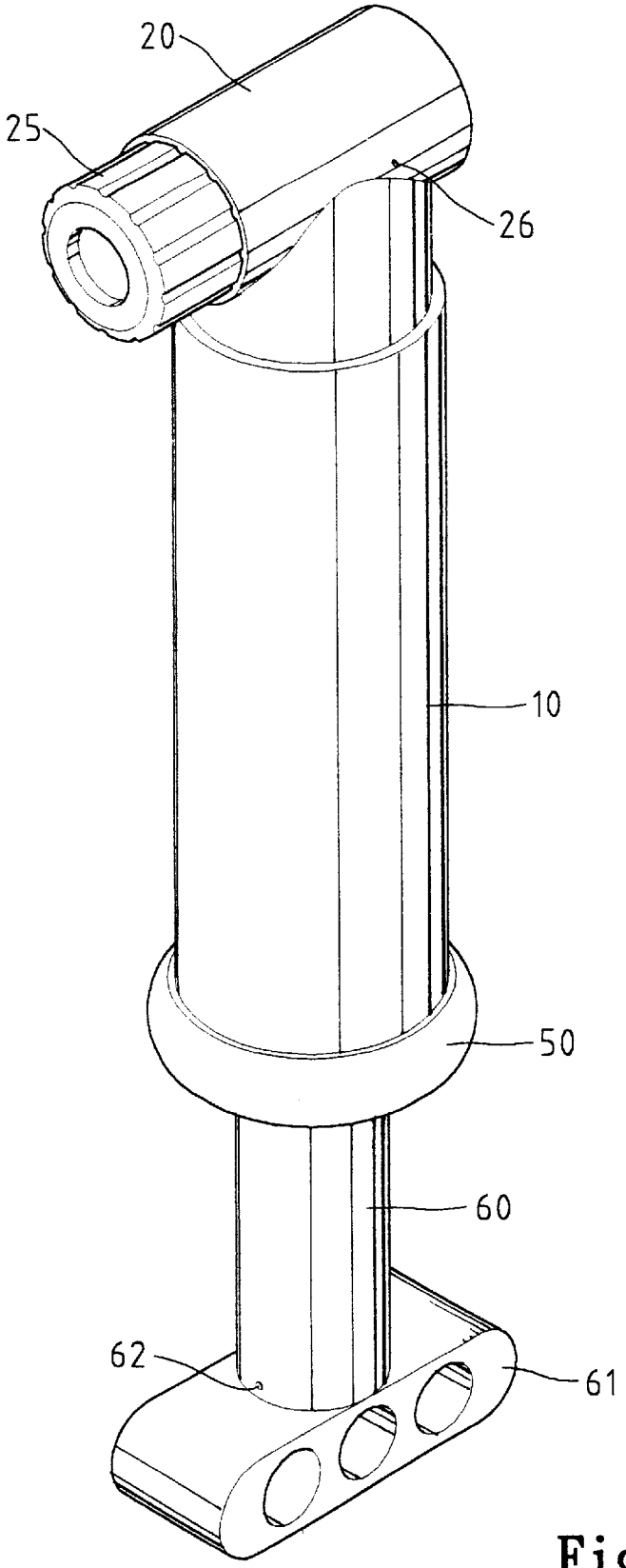
FIG. 1 is a perspective view of a first embodiment of a two-stroke operable pump in accordance with the present invention.
Figure 2:
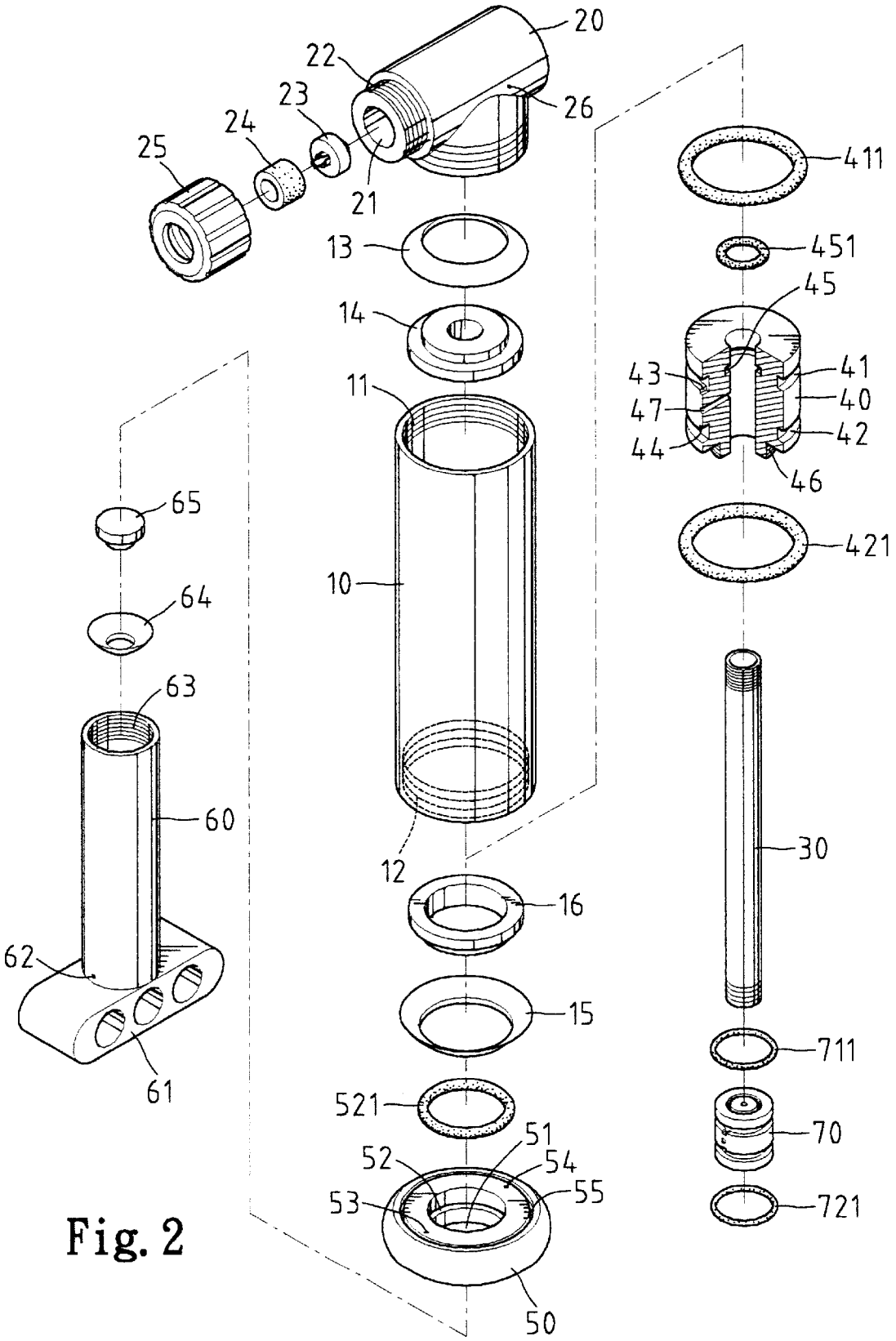
FIG. 2 is an exploded view of the first embodiment of the two-stroke operable pump in accordance with the present invention.
Figure 4:
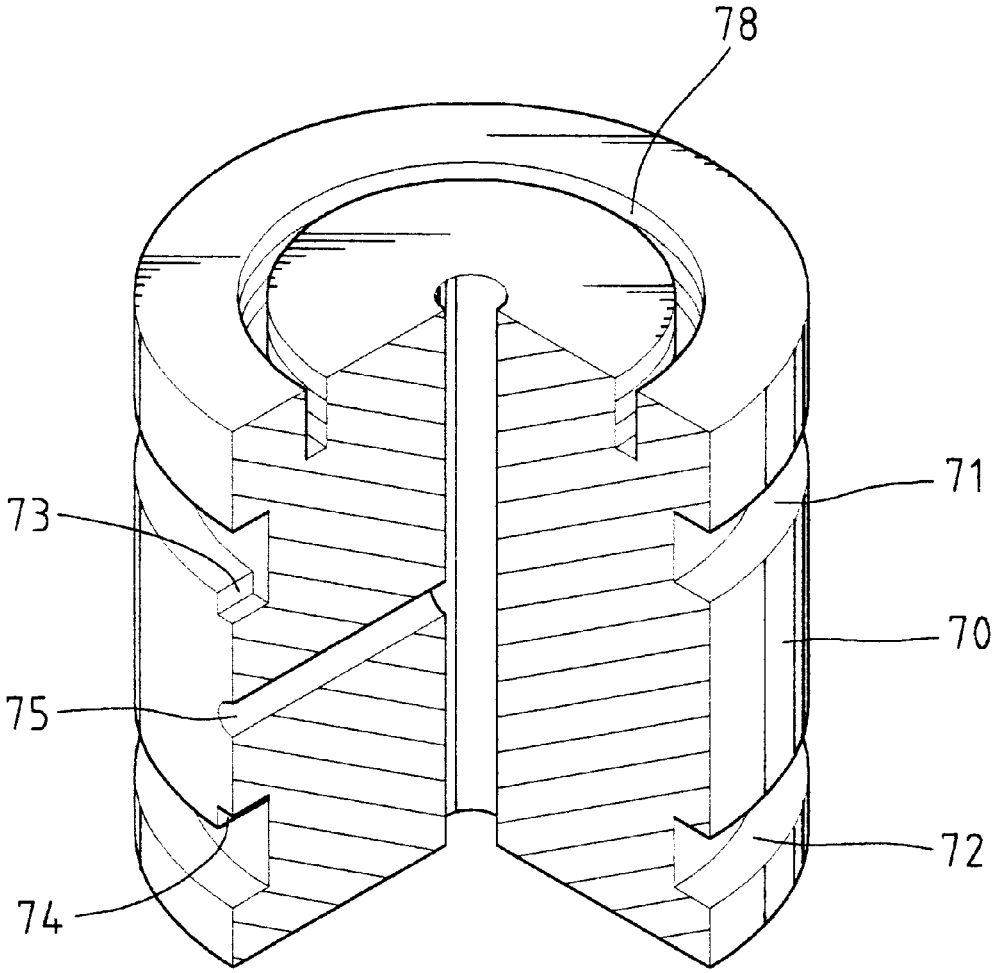
FIG. 4 is a perspective view, partly cutaway, of a plug of the first embodiment of the two-stroke operable pump in accordance with the present invention.
Figure 5:
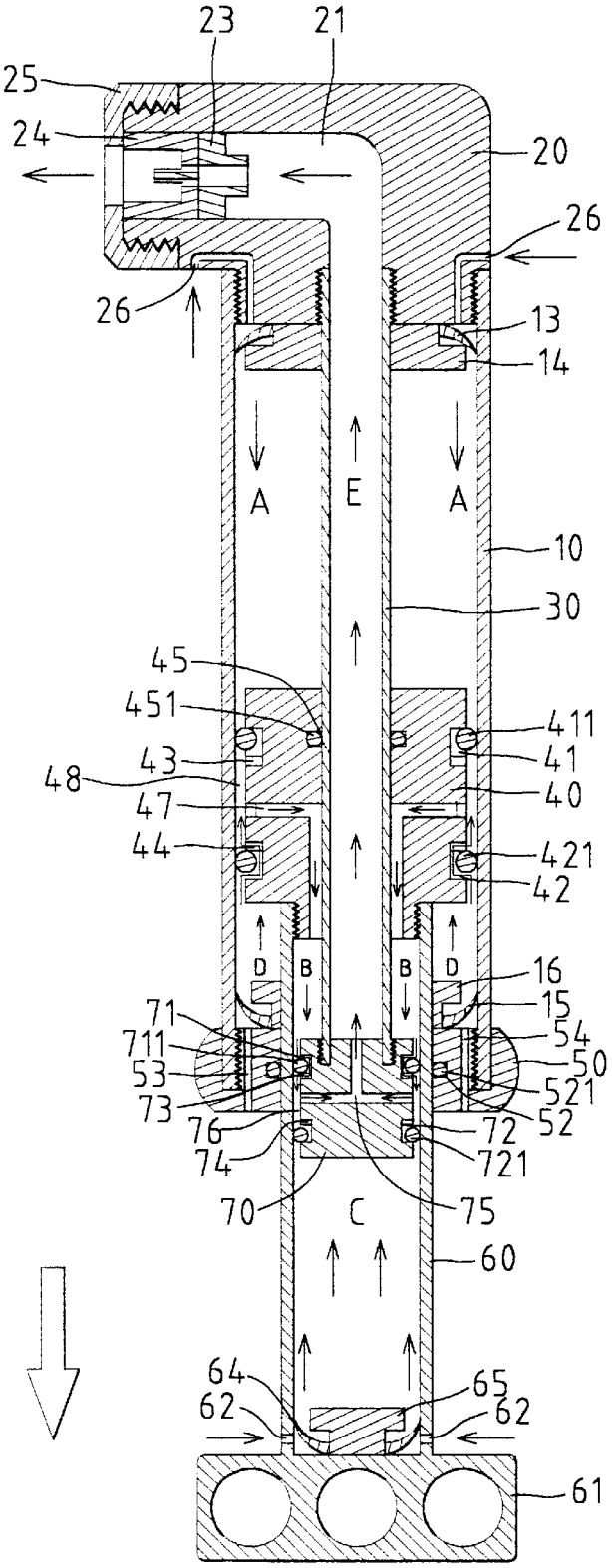
FIG. 5 is a sectional view of the first embodiment of the two-stroke operable pump in accordance with the present invention, illustrating an outward stroke of the piston.

Referring to the drawings and initially to FIGS. 1 and 2, a first embodiment of a two-stroke operable pump in accordance with the present invention generally includes a cylindrical main body 10 defining a chamber (not labeled) therein, a head 20 having a first end threadedly engaged with an inner threading 11 of a first end of the main body 10 and a second end 22, an end cap 25 threadedly engaged with an outer threading (not labeled) of the second end 22 of the head 20, and a piston 40 slidably received in the main body 10. The piston 40 separates the chamber of the main body 10 into an upper chamber A and a lower chamber D (FIG. 5). The head 20 includes a main passage 21 communicated with the upper chamber A, and a nozzle 23 and a nozzle plug 24 are mounted in the second end 22 of the head 20. Referring to FIG. 4, the head 20 further includes two side passages 26 that communicate the upper chamber A of the main body 10 with atmosphere. In addition, an annular diaphragm 13 is mounted to an interior of the first end of the main body 10 adjacent to the side passages 26 and arranged in a manner that air is flowable from atmosphere into the upper chamber A of the main body 10, and the reverse flow is prohibited.

Figure 3:
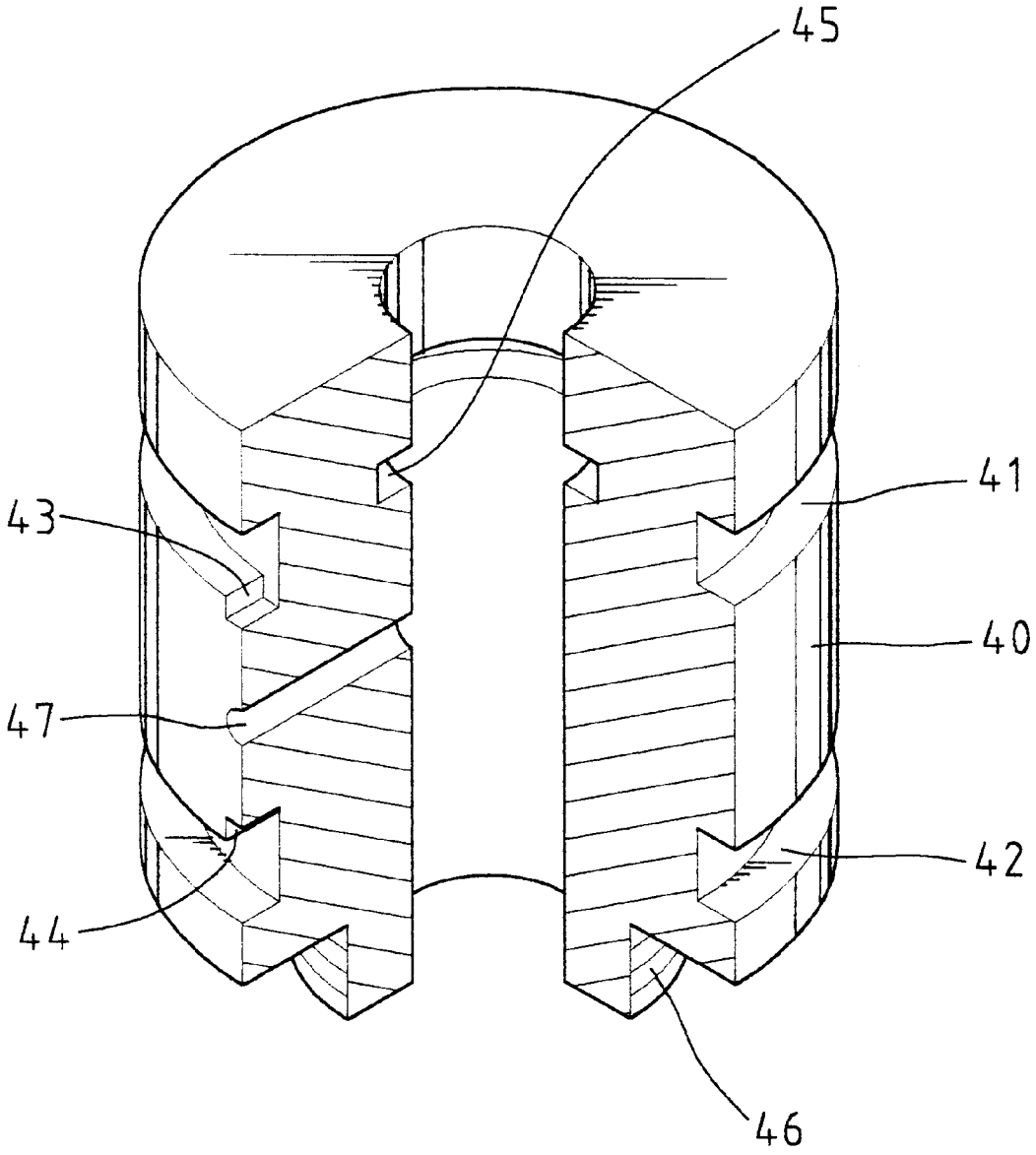
FIG. 3 is a perspective view, partly cutaway, of a piston of the first embodiment of the two-stroke operable pump in accordance with the present invention.
Figure 6:
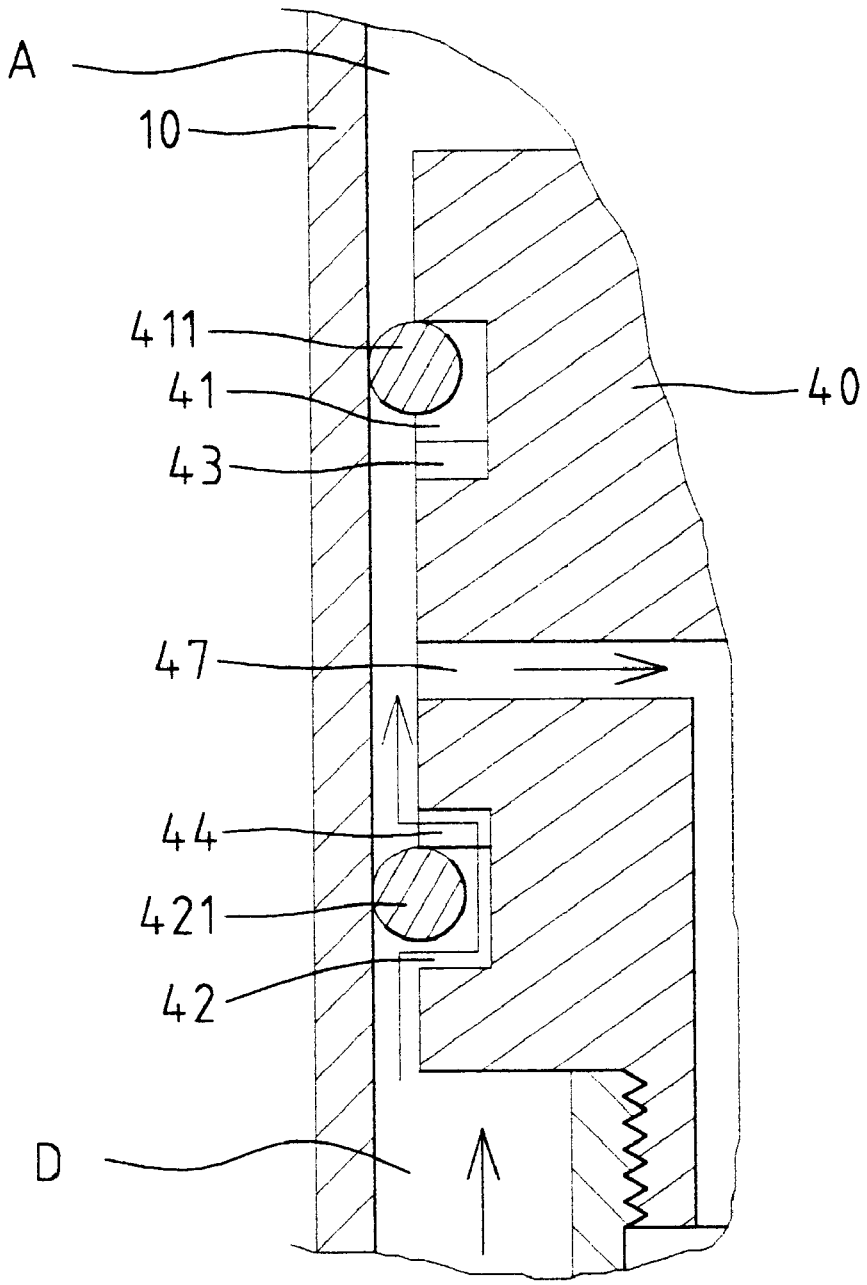
FIG. 6 is an enlarged fragmentary view illustrating the status of two O-rings on the piston during the outward stroke of the piston.

Referring to FIGS. 2 and 5, an inner tube 30 is securely mounted in the main body 10 and supported by an upper support 14, which, in turn, is secured to the first end of the main body 10, best shown in FIG. 5. Referring to FIGS. 3 and 5, the piston 40 is hollow so as to slide along the inner tube 30. An outer periphery of the piston 40 includes two annular grooves 41 and 42 each for receiving an O-ring 411, 421 therein. Each annular groove 41, 42 further includes a notch 43, 44 extended along a longitudinal direction of the piston 40. Referring to FIGS. 5 and 6, an inner periphery of the piston 40 includes a reduced first section for sliding contact with an outer periphery of the inner tube 30 and a second section that has an inner diameter greater than that of the reduced first section. The reduced first section includes an annular groove 45 defined therein for receiving an O-ring 451 therein. The piston 40 further includes a transverse hole 47 extends between the two annular grooves 41 and 42 along a radial direction to communicate an interior of the second section with a space 48 between the annular grooves 41 and 42 and the inner periphery of the main body 10.

A first end of a piston rod 60 is threadedly engaged with an outer threading 46 of the piston 40 to move therewith, and a handle 61 is attached to a second end of the piston rod 60 extended outside the main body 10 for manual operation. The second end of the piston rod 60 includes two side passages 62 that communicate a compartment in the piston rod 60 and atmosphere. An annular flexible diaphragm 64 is mounted in the second end of the piston rod 60 adjacent to the side passages 62 and retained in place by a block 65. The annular flexible diaphragm 64 is arranged in a manner that air is flowable from atmosphere into the compartment of the piston rod 60, and the reverse flow is prohibited.

An end cap 50 is engaged to the second end of the main body 10 by threading 55 of the end cap 50 and threading 12 of the main body 10. The end cap 50 includes a through-hole 51 through which the piston rod 60 is sidably extended. The end cap 50 further includes two passages 53 and 54 that communicate the lower chamber D of the main body 10 with atmosphere. An annular flexible diaphragm 15 is mounted to an interior of the second end of the main body 10 adjacent to the annular passages 53 and 54 and arranged in a manner that air is flowable from atmosphere into the chamber D, and the reverse flow is prohibited. An O-ring groove 52 is provided in the end cap 50 for receiving an O-ring 521 to achieve the sealing effect. A lower support 16 is mounted around the piston rod 60 and above the end cap 50 for retaining the lower annular diaphragm 15 in place.

Referring to FIGS. 4 and 5, a plug 70 is mounted in the piston rod 60 and secured to the lower end of the inner tube 30 by a threading 76 in an upper end thereof. The plug 70 separates a compartment in the piston rod 60 into an upper chamber B and a lower chamber C. An outer periphery of the plug 70 includes two annular grooves 71 and 72 each for receiving an O-ring 711, 721 therein. Each annular groove 71, 72 further includes a notch 73, 74 extended along a longitudinal direction of the plug 70. The plug 70 further includes a transverse hole 75 that extends between the annular grooves 71 and 72 along a radial direction to communicate an interior E of the inner tube 30 with a space 76 between the annular grooves 71 and 72 and the inner periphery of the piston rod 60.

Figure 7:
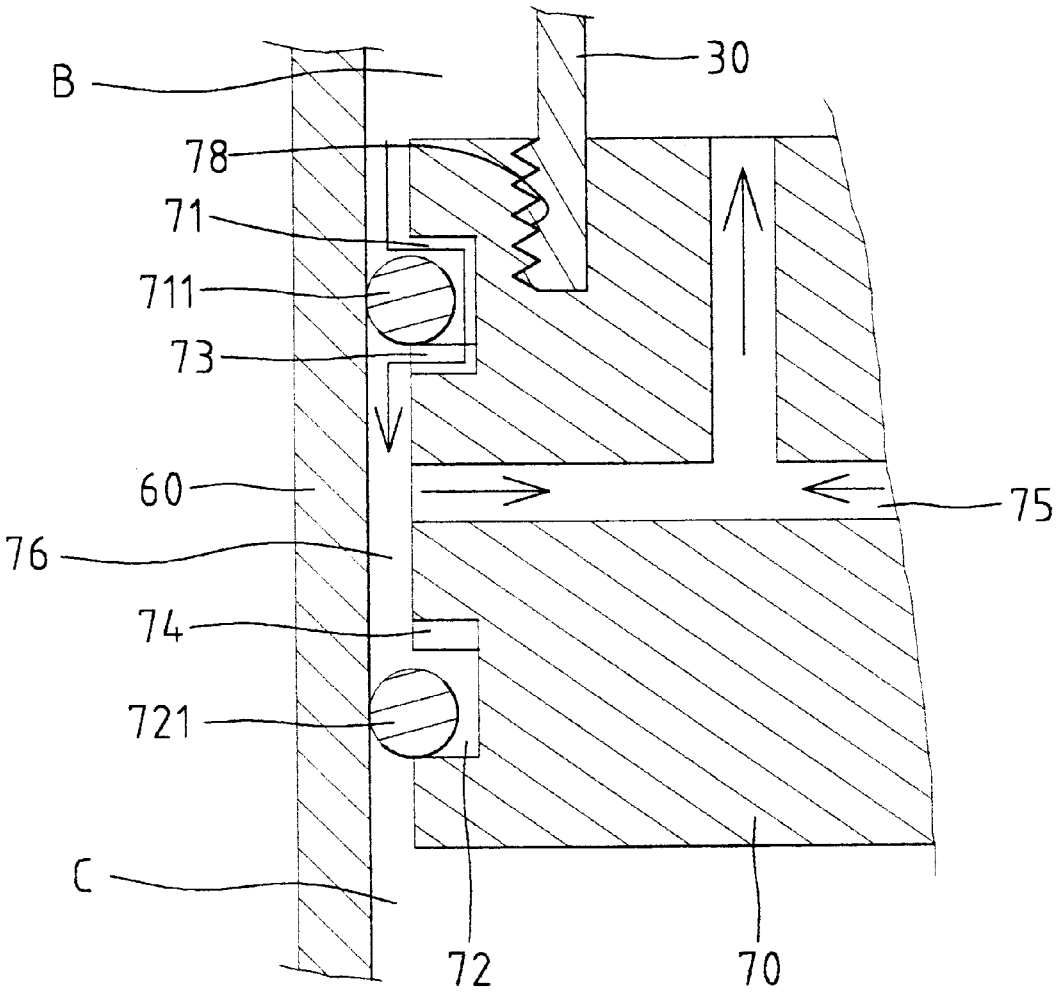
FIG. 7 is an enlarged fragmentary view illustrating the status of two O-rings on the plug during the outward stroke of the piston.

FIG. 5 illustrates an outward stroke of the piston in which the handle 61 is moved away from the main body 10. As shown in FIG. 6, during the outward stroke, the O-ring 411 bears against an upper edge (as viewed from the direction of FIG. 6) of the groove 41 under air pressure such that air is not flowable from the upper chamber A of the main body 10 into the space 48. Yet, the other O-ring 421 is moved to abut against an edge of the notch 44 of the annular groove 42 such that air is flowable from the lower chamber D of the main body 10 into the space 48. Similarly, as shown in FIG. 7, during the outward stroke, the O-ring 721 bears against a lower edge of the groove 72 under air pressure such that air is not flowable from the chamber C into the space 76. Yet, the other O-ring 711 is moved to abut against an edge of the notch 73 of the annular groove 71 such that air is flowable from the chamber B into the space 76.

Thus, as shown in FIG. 5, air in lower chamber D enters an interior E of the inner tube 30 via the space 48, the transverse hole 47, the chamber B, the space 76, and the transverse hole 75. And the air fed into the inner tube 30 is outputted via the main passage 21 and the nozzle 23 to a valve or the like. In addition, ambient air enters the chamber A via the side passages 26 and enters the chamber C via the passages 62 to compensate air and to allow smooth sliding motion of the piston 40 in the main body 10. It is appreciated that the annular diaphragms 13 and 64 act as check valves to prevent reverse flow of air. It is appreciated that a large amount of air in the chamber D and the chamber B are outputted in this outward stroke.

Figure 8:
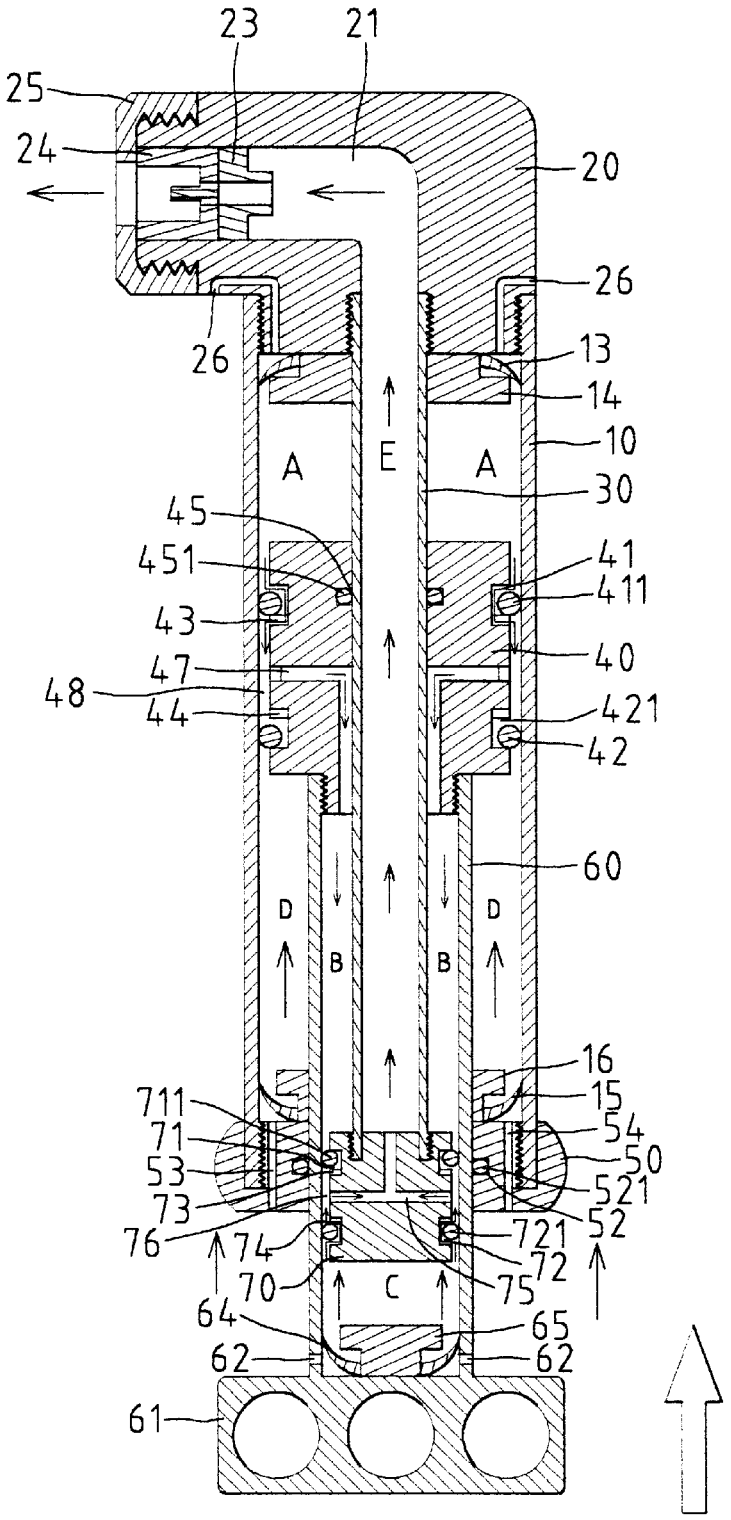
FIG. 8 is a sectional view of the first embodiment of the two-stroke operable pump in accordance with the present invention, illustrating an inward stroke of the piston.
Figure 9:
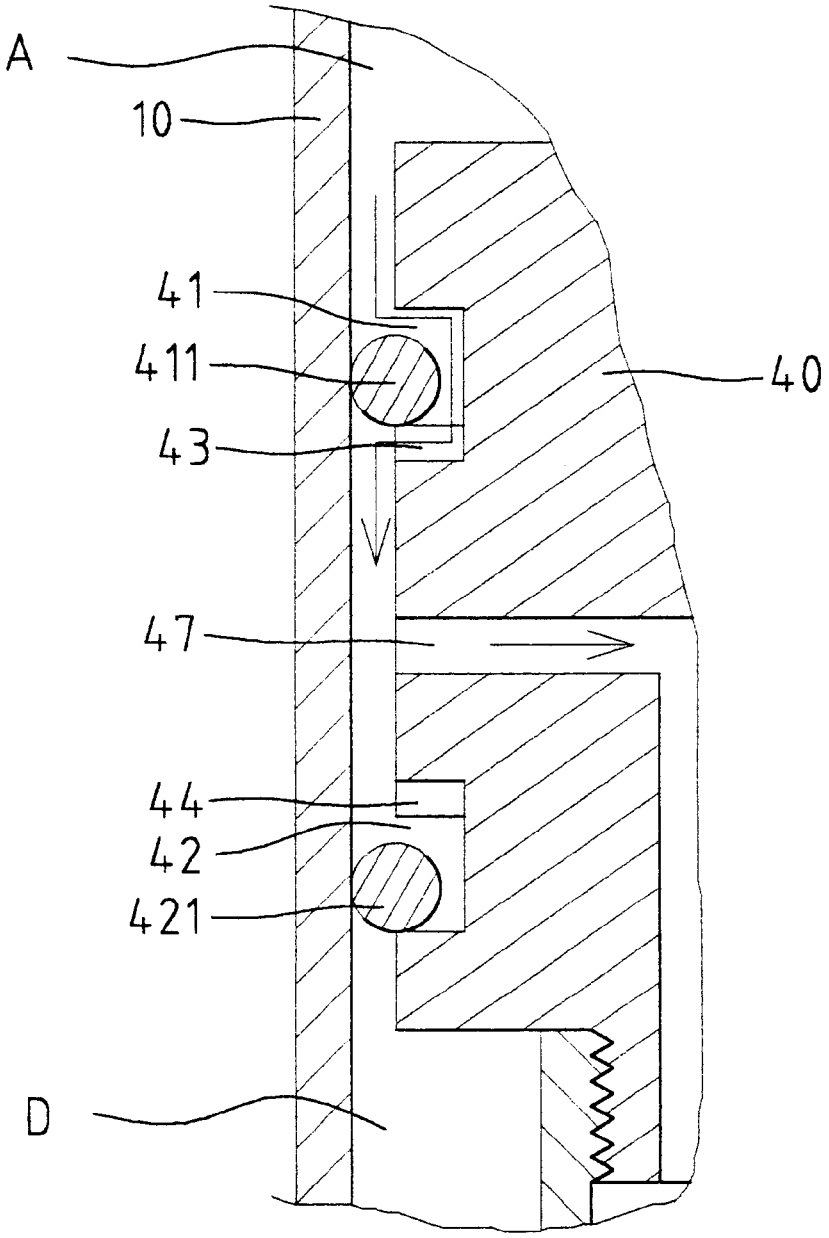
FIG. 9 is an enlarged fragmentary view illustrating the status of the O-rings on the piston during the inward stroke of the piston.
Figure 10:
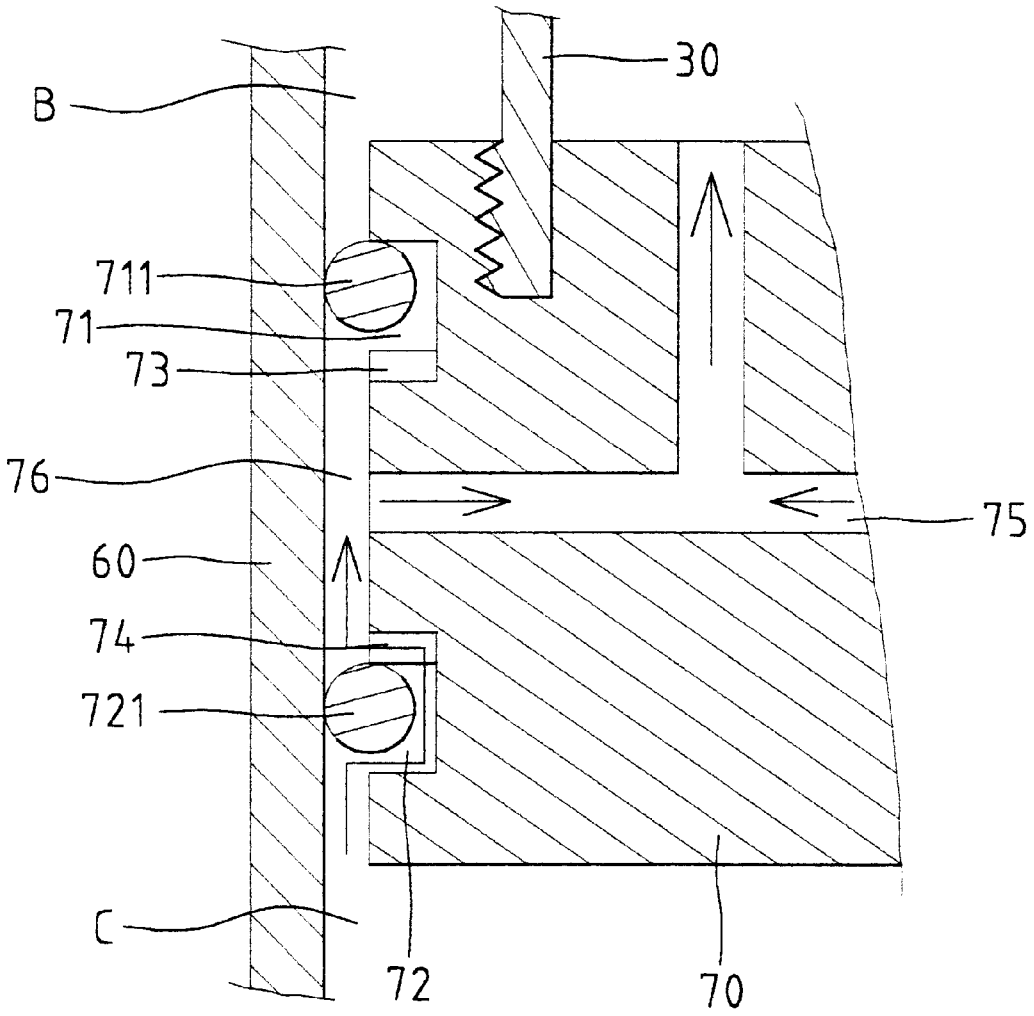
FIG. 10 is an enlarged fragmentary view illustrating the status of the O-rings on the plug during the inward stroke of the piston.

FIG. 8 illustrates an inward stroke of the piston in which the handle 61 is moved toward the main body 10. As shown in FIG. 9, during the outward stroke, the O-ring 421 bears against a lower edge of the groove 42 under air pressure such that air is not flowable from the chamber D into the space 48. Yet, the other O-ring 41 is moved to abut against an edge of the notch 43 of the annular groove 41 such that air is flowable from the chamber A into the space 48. Similarly, as shown in FIG. 10, during the outward stroke, the O-ring 711 bears against an upper edge of the groove 71 such that air is not flowable from the chamber B into the space 76. Yet, the other O-ring 721 is moved to abut against an edge of the notch 74 of the annular groove 72 such that air is flowable from the chamber C into the space 76.

Thus, as shown in FIG. 8, air in the chamber C enters an interior E of the inner tube 30 via the space 76 and the transverse hole 75. And the air fed into the inner tube 30 is outputted via the main passage 21 and the nozzle 23 to a valve or the like. In addition, air in the chamber A enters the chamber B (for air output in the next outward stroke) via the space 48 and the transverse hole 47 to compensate air and to allow smooth sliding motion of the piston 40 in the main body 10. The force required for effecting the inward stroke is relatively small, since the area of the plug is small (F=P*A).

Thus, air is outputted in both strokes. This allows an efficient pumping effect with less labor.

Figure 11:
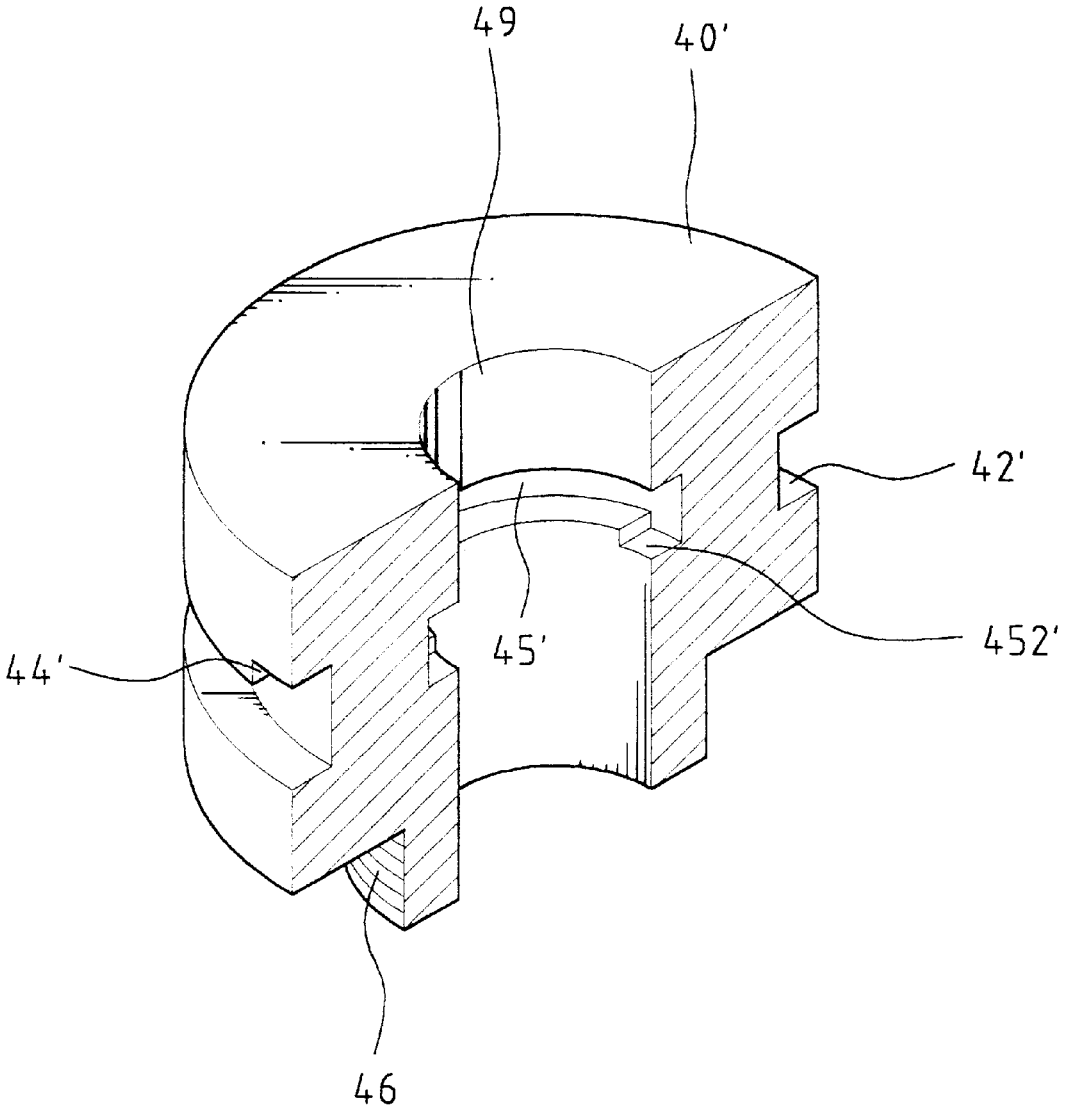
FIG. 11 a perspective view, partly cutaway, of a modified embodiment of the piston of a modified embodiment of the two-stroke operable pump in accordance with the present invention.
Figure 12:
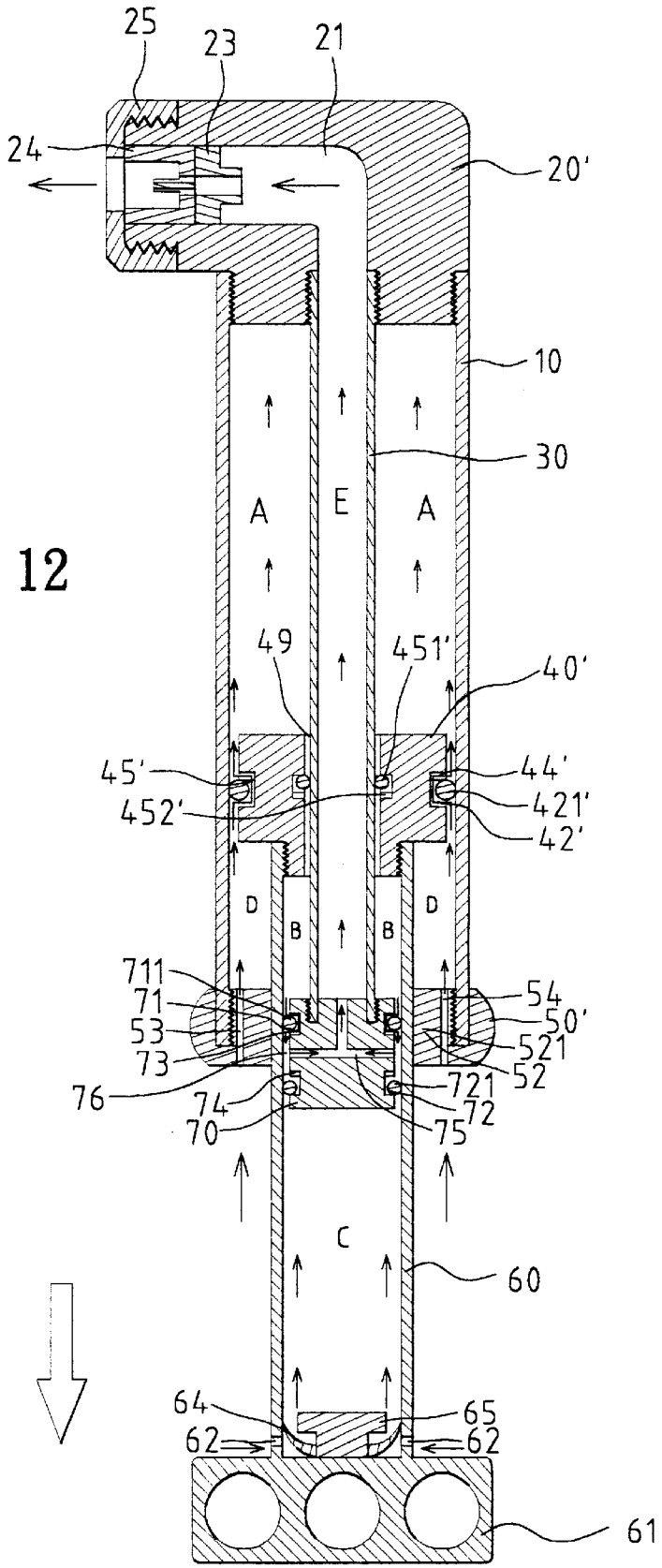
FIGS. 12 and 13 are sectional views respectively illustrating the outward stroke and the inward stroke of the modified embodiment of the two-stroke operable pump in accordance with the present invention.
Figure 13:
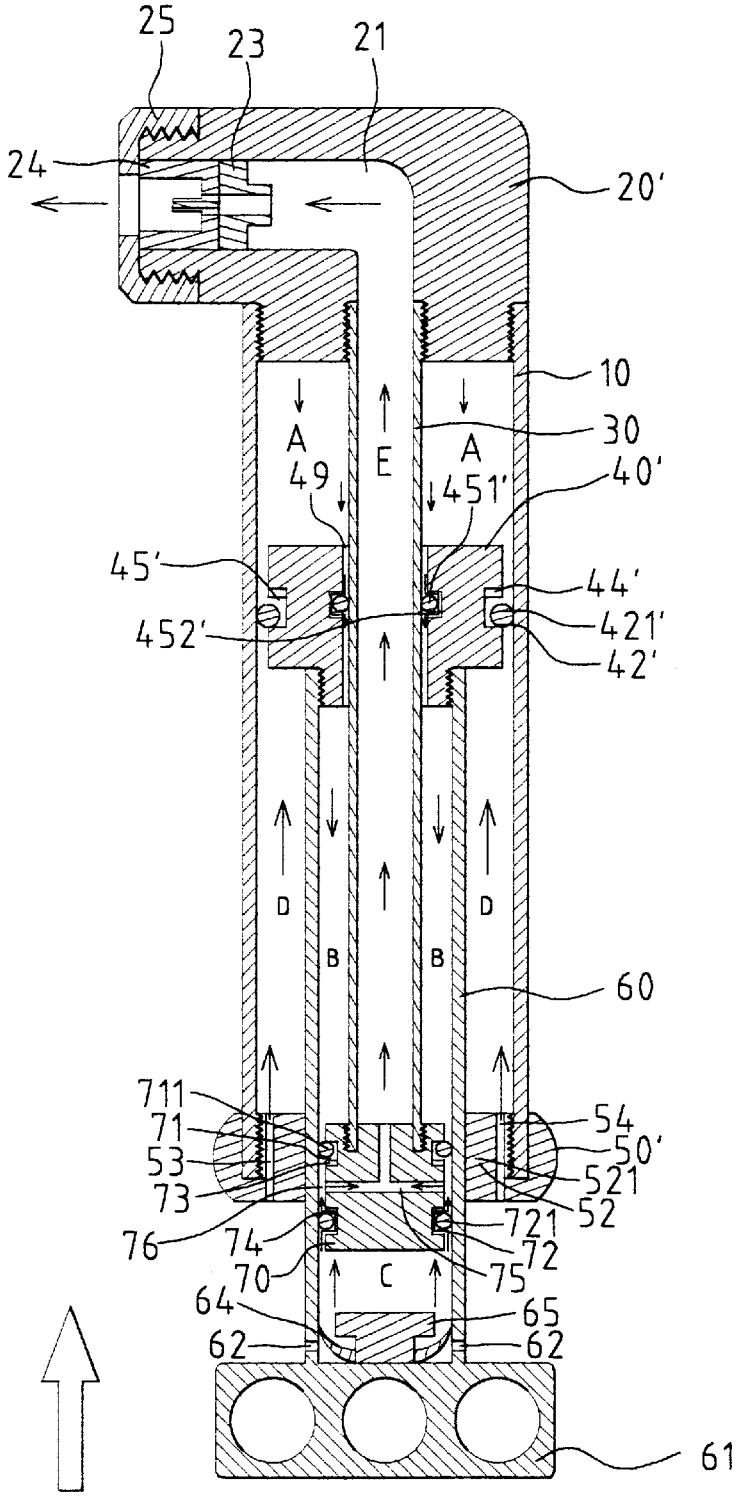

FIGS. 11 through 13 illustrate a modified embodiment of the invention, in which the annular diaphragm 13, the upper support 14, and the side passages 26 in the upper portion of the pump have been omitted. In addition, the annular diaphragm 15 and the lower support 16 have also been omitted. The end cap (now designated by 50') does not include the annular groove 52 and the O-ring 521. Furthermore, the plug (now designated by 40') has only one annular groove. More specifically, as shown in FIGS. 11 and 12, the plug 40' includes an annular groove 42' in an outer periphery thereof and an annular groove 45' in an inner periphery thereof. Each annular groove 42', 451' includes an O-ring 421', 451' therein. The annular groove 42' includes a notch 44' in an upper portion thereof extended along a longitudinal direction of the plug 40'. The annular groove 45' includes a notch 452' in a lower portion thereof extended along a longitudinal direction of the plug 40'. The plug 40' further includes a through-hole 48 through which the inner tube 30 extends.

FIG. 12 illustrates an outward stroke of the piston in which the handle 61 is moved away from the main body 10. During the outward stroke, the O-ring 451' bears against the upper edge of the groove 45' under air pressure such that air is not flowable from the chamber A into the chamber B. Yet, the O-ring 421' is moved to abut against an edge of the notch 44' of the annular groove 42' such that air is flowable from the chamber D into the chamber A. In addition, the O-ring 721 bears against a lower edge of the groove 72 such that air is not flowable from the chamber C into the space 76. Yet, the other O-ring 711 is moved to abut against an edge of the notch 73 of the annular groove 71 such that air is flowable from the chamber B into the space 76.

Thus, as shown in FIG. 12, air in the chamber B enters an interior E of the inner tube 30 via the space 76, and the transverse hole 75. And the air fed into the inner tube 30 is outputted via the main passage 21 and the nozzle 23 to a valve or the like. In addition, ambient air enters the chamber A via the passages 53 and 54, the chamber D, and the notch 44'. Ambient air also enters the chamber C via the passages 62 to compensate air and to allow smooth sliding motion of the piston 40 in the main body 10. It is appreciated that a large amount of air in the chamber E and the chamber B are outputted in this outward stroke.

FIG. 13 illustrates an inward stroke of the piston in which the handle 61 is moved toward the main body 10. During the outward stroke, the O-ring 421' bears against a lower edge of the groove 42' under air pressure such that air is not flowable from the chamber D into the chamber A. Yet, the other O-ring 451' is moved to abut against an edge of the notch 452' of the annular groove 45' such that air is flowable from the chamber A into the chamber B. In addition, the O-ring 711 bears against an upper edge of the groove 71 such that air is not flowable from the chamber B into the space 76. Yet, the other O-ring 721 is moved to abut against an edge of the notch 74 of the annular groove 72 such that air is flowable from the chamber C into the space 76.

Thus, as shown in FIG. 13, air in the chamber C enters an interior E of the inner tube 30 via the space 76 and the transverse hole 75. And the air fed into the inner tube 30 is outputted via the main passage 21 and the nozzle 23 to a valve or the like. In addition, air in the chamber A enters the chamber B via the notch 452' for air output in the next outward stroke. Ambient air enters the chamber D via the passages 53 and 54 to compensate air and to allow smooth sliding motion of the piston 40 in the main body 10. The force required for effecting the inward stroke is relatively small, since the area of the plug is small (F=P*A).

Thus, air is outputted in both strokes. This allows an efficient pumping effect with less labor.

Although the invention has been explained in relation to its preferred embodiment, it is to be understood that many other possible modifications and variations can be made without departing from the spirit and scope of the invention as hereinafter claimed.

What is claimed is:

1. A pump comprising:

a main body defining a chamber therein and including a first end and a second end, a head mounted to the first end of the main body and including a main passage that is adapted to be communicated with a valve, the head further including a first passage, an inner tube securely mounted in the main body and having an interior communicated with the main passage of the head, the inner tube including a first end secured in the first end of the main body and a second end, a hollow piston slidably received in the main body, the hollow piston separating the chamber of the main body into a first chamber adjacent to the head and a second chamber distal to the head, the first chamber being communicated with atmosphere via the first passage of the head, the hollow piston further including a first annular groove defined in an outer periphery thereof and adjacent to the first end of the main body, the hollow piston head further including a second annular groove defined in the outer periphery and adjacent to the second end of the main body, the first annular groove including a first notch extended along a longitudinal direction of the hollow piston, the second annular groove including a second notch extended along the longitudinal direction, of the hollow piston, a first O-ring being mounted in the first annular groove and slidable along the longitudinal direction of the hollow piston, a second O-ring being mounted in the second annular groove and slidable along the longitudinal direction of the hollow piston, the hollow piston including an inner periphery, the inner periphery including a reduced first section in sliding and sealing contact with an outer periphery of the inner tube, the inner periphery further including a second section having an inner diameter greater than that of the reduced first section, the hollow piston further including a first transverse hole defined therein to communicate an interior of the second section with a first space between the first O-ring, the second O-ring, and an inner periphery of the main body, a first valve means mounted in first end of the main body such that air is only flowable from atmosphere to the first chamber of the main body via the first passage, a hollow piston rod having a first end attached to the piston and a second end extended outside the main body, the hollow piston rod including a compartment therein for partially receiving the inner tube, a plug mounted in the piston rod and secured to the second end of the inner tube, the plug separating the compartment in the piston rod into a third chamber that is adjacent to the piston and a fourth chamber that is distal to the piston, the second end of the piston rod including a second passage that communicates with the fourth chamber with atmosphere, the plug including a third annular groove defined in an outer periphery thereof and adjacent to the piston and a fourth annular groove defined in the outer periphery thereof and distal to the piston, the third annular groove including a third notch extended along a longitudinal direction of the inner tube and distal to the piston, the fourth annular groove including a fourth notch extended along a longitudinal direction of the inner tube and adjacent to the inner tube, a third O-ring being mounted in the third annular groove and slidable along the longitudinal direction of the inner tube, a fourth O-ring being mounted in the fourth annular groove and slidable along the longitudinal direction of the inner tube, the plug further including a second transverse hole extended between the third annular groove and the fourth annular groove along a radial direction to communicate an interior of the inner tube with a second space between the third annular groove, the fourth annular groove, and an inner periphery of the piston rod, an end cap mounted to seal the second end of the main body and including a third passage that communicates the second chamber of the main body with atmosphere, a second valve means mounted in second end of the piston rod such that air is only flowable from atmosphere to the fourth chamber of the piston rod via the second passage of the piston rod, a third valve means mounted in second end of the main body such that air is only flowable from atmosphere to the second chamber of the main body via the third passage of the end cap, a handle attached to the second end of the piston rod for operation, wherein when during an outward stroke of the piston in which the handle moves away from the main body, the second O-ring is moved to abut an end edge of the second notch to allow communication between the first space and the second chamber while the first O-ring prevents communication between the first chamber and the first space, the third O-ring is moved to abut an end edge of the third notch to allow communication between the third chamber and the second space while the fourth O-ring prevents communication between the fourth chamber and the second space, such that air in the second chamber is outputted to the main passage via the first space, the first transverse hole, the third chamber, the second space, the second transverse hole, and the inner tube, while ambient air enters the first chamber via the first passage of the head and enters the fourth chamber via the second passage in the second end of the piston rod, and wherein when during an inward stroke of the piston in which the handle moves toward the main body, the first O-ring is moved to abut an end edge of the first notch to allow communication between the first space and the first chamber while the second O-ring prevents communication between the second chamber and the first space, the fourth O-ring is moved to abut an end edge of the fourth notch to allow communication between the second space and the fourth chamber while the third O-ring prevents communication between the third chamber and the second space, such that air in the fourth chamber is outputted to the main passage via the second space, the second transverse hole, and the inner tube, while air in the first chamber enters the third chamber via the first space and the first transverse hole.

2. A pump comprising:

a main body defining a chamber therein and including a first end and a second end, a head mounted to the first end of the main body and including a main passage that is adapted to be communicated with a valve, an inner tube securely mounted in the main body and having an interior communicated with the main passage of the head, the inner tube including a first end secured in the first end of the main body and a second end, a hollow piston slidably received in the main body, the hollow piston separating the chamber of the main body into a first chamber adjacent to the head and a second chamber distal to the head, the hollow piston further including a first annular groove defined in an outer periphery thereof, the hollow piston further including a second annular groove defined in an outer periphery thereof, the first annular groove including a first notch in an upper edge thereof and extended along a longitudinal direction of the hollow piston, the second annular groove including a second notch in a lower edge thereof and extended along the longitudinal direction of the hollow piston, a first O-ring being mounted in the first annular groove and slidable along the longitudinal direction of the hollow piston, a second O-ring being mounted in the second annular groove and slidable along the longitudinal direction of the hollow piston, a hollow piston rod having a first end attached to the piston and a second end extended outside the main body, the hollow piston rod including a compartment therein for partially receiving the inner tube, a plug mounted in the piston rod and secured to the second end of the inner tube, the plug separating the compartment in the piston rod into a third chamber that is adjacent to the piston and a fourth chamber that is distal to the piston, the second end of the piston rod including a first passage that communicates with the fourth chamber with atmosphere, the plug including a third annular groove defined in an outer periphery thereof and adjacent to the piston and a fourth annular groove defined in the outer periphery thereof and distal to the piston, the third annular groove including a third notch extended along a longitudinal direction of the inner tube and distal to the piston, the fourth annular groove including a fourth notch extended along a longitudinal direction of the inner tube and adjacent to the inner tube, a third O-ring being mounted in the third annular groove and slidable along the longitudinal direction of the inner tube, a fourth O-ring being mounted in the fourth annular groove and slidable along the longitudinal direction of the inner tube, the plug further includes a second transverse hole extended between the third annular groove and the fourth annular groove along a radial direction to communicate an interior of the inner tube with a space between the third annular groove, the fourth annular groove, and an inner periphery of the piston rod, an end cap mounted to seal the second end of the main body and including a second passage that communicates the second chamber of the main body with atmosphere, a first valve means mounted to in second end of the piston rod such that air is only flowable from atmosphere to the fourth chamber of the piston rod via the first passage of the piston rod, a second valve means mounted to in second end of the main body such that air is only flowable from atmosphere to the second chamber of the main body via the second passage of the end cap, a handle attached to the second end of the piston rod for operation, wherein when during an outward stroke of the piston in which the handle moves away from the main body, the first O-ring is moved to abut an end edge of the first notch to allow communication between the first chamber and the second chamber while the second O-ring prevents communication between the first chamber and the third chamber, the third O-ring is moved to abut an end edge of the third notch to allow communication between the third chamber and the space while the fourth O-ring prevents communication between the fourth chamber and the space, such that air in the third chamber is outputted to the main passage via the space, the transverse hole, and the inner tube, while ambient air enters the third chamber via the second end of the piston rod, and ambient air enters the first chamber via the second chamber and the first notch, wherein when during an inward stroke of the piston in which the handle moves toward the main body, the second O-ring is moved to abut an end edge of the second notch to allow communication between the first chamber and the third chamber while the first O-ring prevents communication between the second chamber and the first chamber, the fourth O-ring is moved to abut an end edge of the fourth notch to allow communication between the space and the fourth chamber while the third O-ring prevents communication between the third chamber and the space, such that air in the fourth chamber is outputted to the main passage via the space, the transverse hole, and the inner tube, while air in the first chamber enters the third chamber via the second notch and ambient air enters the second chamber via the first passage.

* * * * *